United States Patent [19]

Hedström

[11] Patent Number: 4,602,567

[45] Date of Patent: Jul. 29, 1986

[54] CONVEYOR MECHANISM MOVABLE ALONG A GUIDE RAIL

[75] Inventor: Ture Hedström, Norsborg, Sweden

[73] Assignee: Tumac AB, Norsborg, Sweden

[21] Appl. No.: 777,552

[22] Filed: Sep. 16, 1985

Related U.S. Application Data

[63] Continuation of Ser. No. 468,938, Feb. 23, 1983, abandoned.

[30] Foreign Application Priority Data

Feb. 25, 1982 [SE] Sweden ..... 8201163

[51] Int. Cl.[4] ..... B61B 3/00

[52] U.S. Cl. ..... 105/153; 104/1 B; 104/93

[58] Field of Search ..... 105/1 B, 141, 148, 150, 105/153, 154, 156; 104/89, 93, 118, 1 B; 295/9 R, 33, 34

[56] References Cited

U.S. PATENT DOCUMENTS

| | | | |
|---|---|---|---|
| 573,722 | 12/1896 | Feldmann | 105/153 |
| 717,340 | 12/1902 | Cadmus | 295/9 R |
| 1,754,995 | 4/1930 | Galligan | 295/9 R |
| 1,986,413 | 1/1935 | Ruemelin | 105/153 |
| 3,261,304 | 7/1966 | Henderson | 105/148 |
| 3,528,539 | 9/1970 | Speaker et al. | 104/89 |
| 3,698,326 | 10/1972 | Schurch et al. | 105/153 |
| 3,935,822 | 2/1976 | Kaufmann | 105/153 |
| 3,987,734 | 10/1976 | Horn | 105/148 |
| 4,015,537 | 4/1977 | Graef et al. | 105/153 |
| 4,463,683 | 8/1984 | Uttscheid | 105/29 R |

FOREIGN PATENT DOCUMENTS

| | | | |
|---|---|---|---|
| 927741 | 5/1947 | France | 104/1 R |

*Primary Examiner*—Robert B. Reeves
*Assistant Examiner*—Dennis H. Pedder
*Attorney, Agent, or Firm*—Burns, Doane, Swecker & Mathis

[57] ABSTRACT

A device intended for the conveyance of goods utilizing a guide-rail (2) as a goods-conveying track, and a mechanism (4) driven electrically or in some other way and capable of interacting with the goods. The mechanism (4) exhibits two wheels (8,9) capable of interacting with the opposite sides of the guide-rail (2) in relation to which the area of contact (20') of the weight of the goods is located to the side of the wheels (8,9) and the guide-rail (2). The two wheels (8,9) are connected together so as to be driven in synchronism by a driving motor (14). The distance between the driving surfaces of the driving wheels facing the guide-rail is selected so as to match the shape of the driving surfaces in such a way that the space formed between the driving surfaces matches the profile of the guide-rail (2). One of the wheels is divided into two parts (91,92) and has the parts held together by spring pressure (93). A plane including the axes of rotation of the wheels forms, for different degrees of inclination, a variable angle with a plane of a normal transverse cross-section of the guide rail and this angle does not exceed 15 degrees.

8 Claims, 6 Drawing Figures

CONVEYOR MECHANISM MOVABLE ALONG A GUIDE RAIL

This application is a continuation, of application Ser. No. 468,938, filed Feb. 23, 1983, now abandoned.

TECHNICAL FIELD

The present invention relates to a device intended for the conveyance of goods and in particular to a device of this kind which utilises a guide-rail as the goods-conveying track together with an organ driven electrically or in some other way and capable of interacting with the goods. This organ exhibits two wheels capable of interacting with opposite sides of the guide-rail in relation to which the point of contact of the weight of the goods is located to the side of the wheels and the guide.

It is clear that the areas of application for a device intended for the conveyance of goods of the nature described above are numerous, although simply by way of an example reference may be made to the different transport requirements within industry, the conveyance of persons, especially the handicapped, up and down stairs, and the conveyance of refuse containers up and down stairs, etc.

DESCRIPTION OF THE PRIOR ART

Devices intended for the conveyance of goods have previously been disclosed which utilise a guide-rail attached to a ceiling as the goods-conveying track. A device of this kind is used, for example, within the meat processing industry for the transport of carcasses from one processing point to another. In this case the goods are usually conveyed along a horizontal guide-rail.

Other devices intended for the conveyance of goods have also previously been disclosed which utilise a vertically extending guide-rail as the goods-conveying track. A device of this kind is used, for example, within the bakery industry for raising sacks from one level to a higher level. An example of a device of this kind is described in Swedish Patent Specification No. 7976.

Also previously disclosed is the method of driving electrically or by some other means organs capable of interacting with the goods in order to facilitate the conveyance of the goods. Also previously disclosed is the method of causing the organ to have two wheels capable of interacting with the opposite sides of the guide-rail whereby the area of contact of the weight of the goods is located to the side of the wheels and the guide-rail. It is usual in this case for the distance between the surfaces of the wheels facing the guide-rail to be considerably greater than the thickness of the guide-rail, which means that the wheels bear against the guide-rail at different heights. Finally, reference may be made to the disclosure in German Patent Specification No. 90 297 of a device in which two driving wheels bear on either side of a guide-rail, said driving wheels being driven commonly by one and the same driving device.

DESCRIPTION OF THE PRESENT INVENTION

TECHNICAL PROBLEM

It is clear that a large number of different technical problems are associated with the conveyance of goods and that in practice these problems have led to the use of special goods-conveying devices for the conveyance of goods along horizontal guide-rails and to the use of other goods-conveying devices for the conveyance of goods along vertical guide-rails. Other types of device have usually been necessary where the conveyance of goods was required to take place along an inclined or somewhat sloping track.

Most of the different transport devices for different applications indicate the existence of an exacting technical problem in designing a single transport device which can be used for many different purposes and within a wide range of different industries.

Accordingly an exacting technical problem is associated with the design of a device intended for the conveyance of goods of such a nature that it will not only be of simple construction, thereby having small external dimensions, but will also be suitable for the conveyance of goods along a horizontal guide-rail, and will also be suitable for the conveyance of goods along a vertical guide-rail, and will also permit the goods to be conveyed if the guide-rail is caused to assume any angular value between the angular values for the horizontal and for the vertical position.

An exacting technical problem has been associated for some time with the design of a device for the conveyance of goods in which the installation costs for the device are low and in which the installation does not restrict the available space or only restricts it to a small extent. The available space shall be capable of being used for its intended purpose, irrespective of whether the goods-conveying device is or is not present.

An exacting technical problem is also associated with providing conditions such that the device will be able to move along the guide-rail even if the guide-rail exhibits irregularities.

An exacting technical problem is also encountered in relation to the horizontal conveyance of goods in providing conditions under which tension will exist between the driving wheels, said tension increasing when the goods are conveyed in an inclined or vertical plane.

Finally, an exacting technical problem is associated with providing conditions such that the device will be clamped firmly against the guide-rail in the event of the failure of one or both of the shafts for the driving wheels.

SOLUTION

The present invention relates to a device intended for the conveyance of goods of such a nature that it utilises a guide-rail as the goods-conveying track together with an organ or mechanism driven electrically or in some other way and capable of interacting with the goods so that the goods can be moved along the guide-rail. The mechanism exhibits two wheels capable of interacting with the opposite sides of the guide-rail. Also, the point of contact of the weight of the goods shall be located to the side of one of the wheels and the guide-rail.

The two wheels are connected together so as to be driven in synchronism by a single driving motor. The driving surfaces facing the guide-rail also have a shape which matches the profile of the guide-rail.

It has been found to be particularly advantageous for the guide-rail to have at least two surfaces forming an angle, and for the driving surfaces to be given a matching angular form.

The present invention also offers the possibility of causing the guide-rail to serve as a steering device intended to change the direction of the mechanism in relation to the guide. A steering device of this kind or a steering rail or a steering rail profile may also be positioned alongside the guide-rail, preferably running parallel with the guide-rail along its entire length.

In accordance with the present invention the two wheels and the point of contact of the weight of the goods shall, in the case of the horizontal conveyance of goods, be located in or at least essentially in a vertical plane. This means that, when the goods are conveyed along a vertically extending guide-rail, the two wheels and the point of contact of the weight of the goods will lie in or at least essentially in a horizontal plane. As the angle at which the goods are being conveyed gradually changes from horizontal conveyance to vertical conveyance of the goods, the plane of the two wheels and the area of contact will change its angle from being in a vertical plane to being in a horizontal plane.

In the event of an electrically driven mechanism being specified it is recommended that the current-carrying and voltage-carrying rails are arranged so as to run parallel with or inside the guide-rail.

The present embodiment requires the driving motor and its associated gear box to be arranged to one side of a plate, and the two driving wheels to be located to the other side of the plate and to be connected together via a system of gear wheels.

The distance between the axes of rotation of the driving wheels is essentially the same as the distance between the point of contact of the weight of the goods and the axis of rotation of the closest driving wheel. The point of contact of the weight of the goods is applied via a freely-rotating sleeve arranged around a fixed shaft attached to the plate.

The present invention also incorporates the unique design feature in which one of the driving wheels is split at right-angles to the axis of rotation and in which the two halves of the wheel are forced towards each other by spring pressure. The spring pressure is variable.

ADVANTAGES

The advantages which may be regarded as being associated with a device intended for the conveyance of goods in accordance with the present invention are principally the very simple installation work involved in positioning a guide-rail along the track on which it is proposed to convey the goods, and also that the device is designed in such a way that it is able to transport or convey goods both along a horizontal guide-rail and along a vertical guide-rail, and also along a guide-rail which forms an angle somewhere between the angles for a horizontal guide-rail and for a vertical guide-rail.

BRIEF DESCRIPTION OF THE DRAWINGS

A preferred embodiment of a device intended for the conveyance of goods in accordance with the present invention is described below in greater detail with reference to the attached drawing, in which.

DESCRIPTION OF THE PREFERRED EMBODIMENT

As previously mentioned, the device intended for the conveyance of a load which is significant to the present invention may be used in a range of different applications, although in the following specification the application of the invention will be illustrated in relation to a goods conveyor track intended to be used for the transport of handicapped persons up and down stairs.

Figure 1:
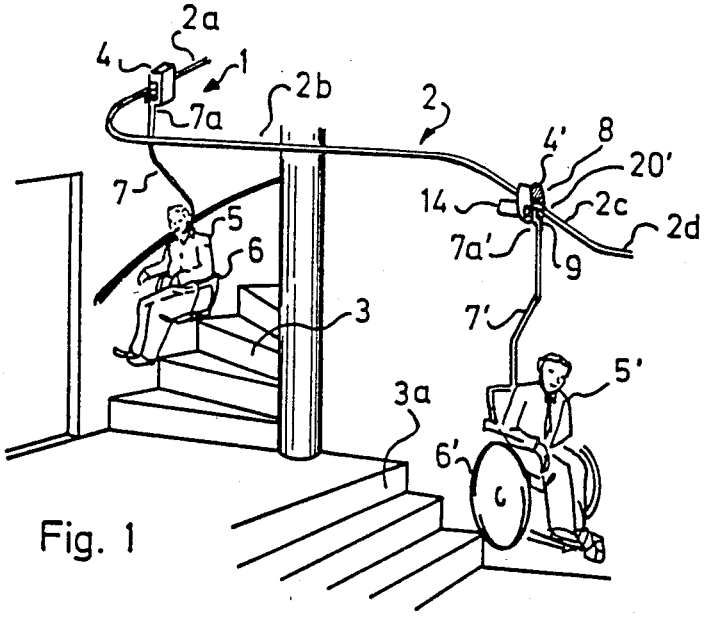
FIG. 1 shows the invention being used in a typical application.

FIG. 1 shows a perspective view of a staircase in which the device intended for the conveyance of goods in accordance with the invention is being used. The goods-conveying device 1 is designed to run along a guide-rail 2, which is positioned above the stairs 3 and the stairs 3*a*, with a section 2*a* forming an angle of approximately 30° to the horizontal plane, a section 2*b* extending essentially horizontally and connected to the section 2*a*, a section 2*c* running at something of an inclined angle and also connected to the section 2*b*, and finally a section 2*d* running essentially horizontally. The guide-rail 2 is used as the goods-conveying track. It should be pointed out that the guide-rail 2 is attached to the ceiling or to parts of the walls by means of fixing devices 19 which interact with the guide-rail in the manner illustrated in FIG. 2.

Figure 2:
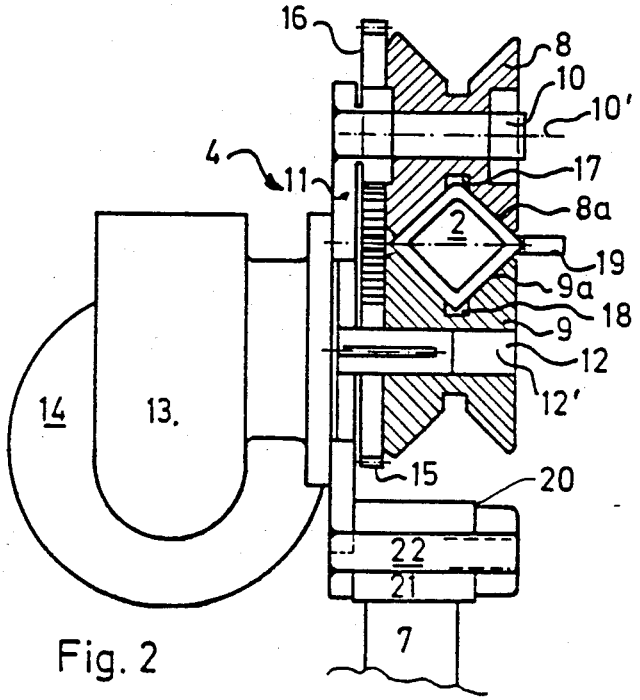
FIG. 2 shows a sectional view of an organ belonging to the device interacting with a guide-rail.

Mechanism 4 which is driven electrically or in some other way is fitted, as illustrated in more detail in FIG. 2, with wheels interacting with the opposite sides of the guide-rail; the point of contact of the weight of the goods is located to the side of the wheels and the guide-rail.

FIG. 1 shows that the goods are suspended from the mechanism 4 and have their centre of gravity located beneath the guide-rail 2.

FIG. 1 also shows the manner in which the present invention may be applied to a handicapped person 5 sitting in a chair 6 which is attached to the mechanism 4 via one end 7*a* of a bar 7 in such a way that it is free to swivel. Similarly, FIG. 1 also illustrates a person 5' sitting in a wheelchair 6' which is connected by means of a previously disclosed mechanism to the bar 7', of which one end 7*a'* is attached to the organ 4' in such a way that it is free to swivel.

FIG. 2 shows a sectional view through part of an electrically driven mechanism 4 capable of interacting with the goods and being utilised in the embodiment in accordance with FIG. 1.

The power supply to the electrically driven organ 4 may, of course, be provided via an electrical cable, although it may be appropriate to arrange the current-carrying and voltage-carrying rails to run parallel with the guide-rail 2, whereby the organ 4 will require to be fitted with collector shoe gear to interact with the conductor rails. The controls used for moving the mechanism 4 in one direction or the other or for causing the mechanism to stop may be in the form of a control panel connected to the mechanism 4 via a cable, although this is not illustrated here.

The mechanism 4 is fitted with an upper wheel 8 and with a lower wheel 9. The upper wheel 8 is attached via a shaft 10 to a plate 11, whereas the lower wheel 9 interacts with a shaft 12 fitted with a toothed wheel 13' connected to an electric motor 14. The toothed wheel 13' is attached to the plate 11.

The two wheels 8 and 9 are connected together so as to be driven in synchronism by the driving motor 14, which takes place by the wheel 9 interacting with a toothed wheel 15 and by the wheel 8 interacting with a toothed wheel 16, said toothed wheels being in mesh with each other.

The distances between the driving surfaces 8*a*,9*a* of the driving wheels 8,9 facing the guide-rail 2 are specified in such a way, and the shapes of the driving surfaces are specified in such a way that the space formed between the driving surfaces matches the profile of the guide-rail 2.

The typical embodiment described here shows that the guide-rail has been given a rectangular cross-section and more specifically a square cross-section, thereby enabling the driving surfaces to be given an L-shaped cross-section. The driving wheel 8 is, of course, designed to have a fillet 17 and the driving wheel 9 is also designed to have a fillet 18 so that the driving surfaces 8*a*,9*a* will make contact with the guide-rail 2 over their entire surface area in the plane shown in FIG. 2.

A number of discrete fixing devices 19 are used to hold the guide-rail 2 in its desired attitude.

In the event of the guide-rail profile being specified in accordance with the typical embodiment the mechanism 4 will match the guide-rail 2 precisely, and the mechanism will be unable to turn around the guide-rail.

One particular feature of FIG. 2 is the fact that, if goods are being conveyed horizontally along a horizontal guide-rail 2, the two wheels 8 and 9 and the area of contact 20 of the weight of the goods will lie in or essentially in a vertical plane. This means that the weight of the goods will be transferred to and supported exclusively by the wheel 8 and the shaft 10 and that only the pressure existing between the driving surfaces 8*a* and the upper L-shaped surface of the guide-rail 2 will provide the conditions required for moving the goods, provided that the necessary normal force and friction occur at that point.

FIG. 2 shows that the driving motor 14 and its associated gear box 13 are arranged to one side of the plate 11 and that the output shaft from the gear box extends through the plate 11 and interacts on the other side of the plate 11 with the driving wheel 9, said driving wheel being connected to the driving wheel 8 via the system of toothed wheels 15,16. The plane in which the load of the goods is to be applied should be specified so as to lie beneath the guide-rail 2 in order to eliminate imbalance and torsional stress on the guide-rail 2.

The distance between the axes of rotation 10' and 12' of the driving wheels is essentially the same as the distance between the area of contact 20 of the weight of the goods and the axis of rotation 12' located closest to the point of contact. The Figure also shows that the area of contact 20 of the weight of the goods shall be applied via a freely-rotating sleeve 21 arranged around a fixed shaft 22 attached to the plate 11.

Figure 3:
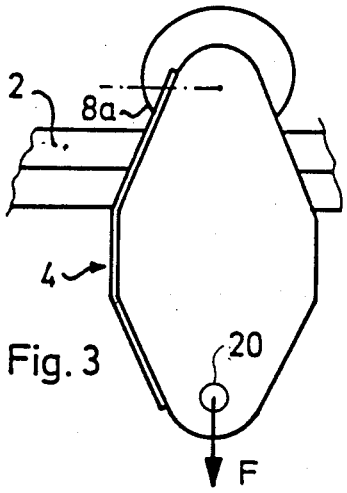
FIG. 3 shows a side-view of the organ with the guide-rail arranged horizontally.

FIG. 3 shows that, in the case of a guide-rail 2 which extends horizontally, the wheels 8 and 9 and the area of contact 20 of the weight of the load "F" lie in a vertical plane, and that the force which is applied between the driving surface 8*a* of the wheel 8 and the guide-rail 2 is essentially the same as the weight of the goods.

Figure 4:
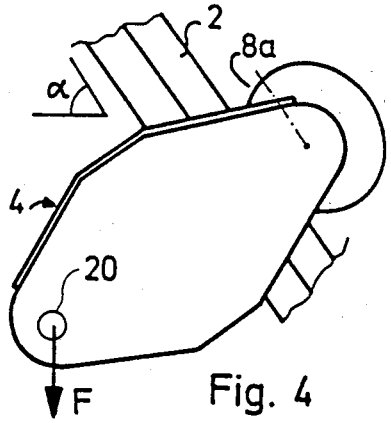
FIG. 4 shows a side-view of the organ with the guide-rail arranged at an inclined angle.
Figure 5:
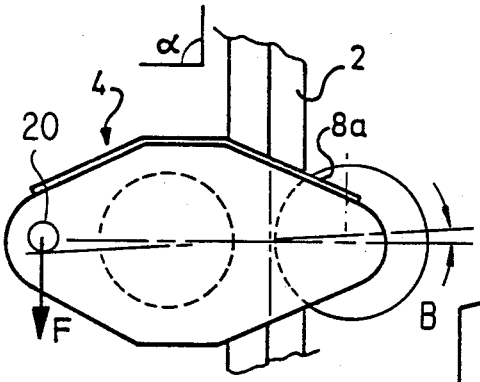
FIG. 5 shows a side-view of the organ with the guide-rail arranged vertically.

In the case of transport along a guide-rail forming an angle $\alpha$ in relation to the horizontal plane in accordance with FIG. 4, it is clear that the area of contact 20 of the weight of the goods will change its position and will give rise to a breaking stress between the wheels 8 and 9, said breaking stress having the effect of increasing the normal pressure on the driving surfaces 8*a* and 9*a* against the guide-rail 2. The larger the angle $\alpha$ the greater will be the normal pressure, at the same time as which the normal force will increase in proportion to the increasing weight of the goods. The normal forces and the effect of the weight of the goods achieve their maximum values in the vertically extending guide-rails in accordance with FIG. 5.

Figure 6:
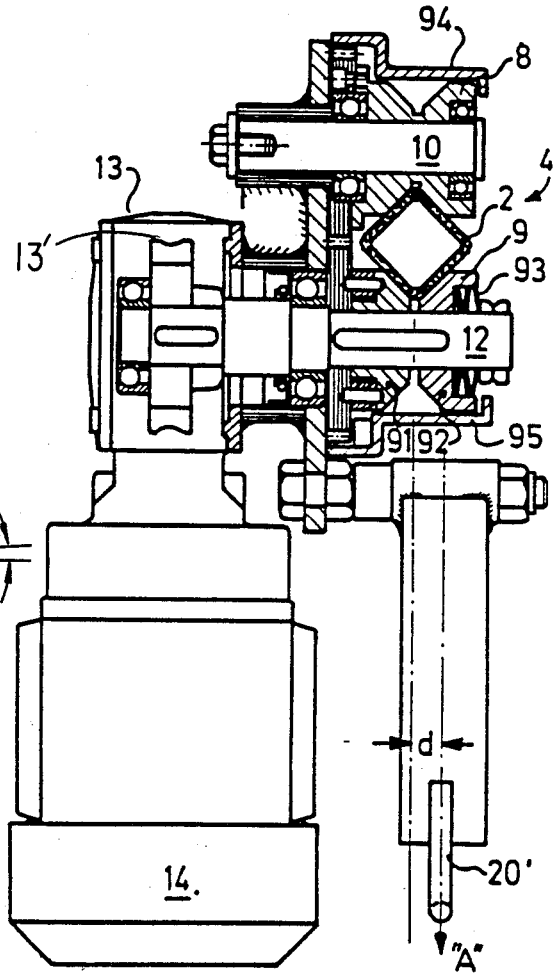
FIG. 6 shows an alternative embodiment of the device in accordance with FIG. 2.

FIG. 6 shows that one of the driving wheels is split into two parts 91 and 92, said parts being pressed against each other by a set of Belleville springs 93. This is designed in such a way that a small force presses the two parts of the wheel 91 and 92 against each other so as to produce a certain small level of normal pressure when the goods are being conveyed horizontally. When goods are being conveyed upwards and at an angle the force between the two parts of the wheel will increase so that they are forced away from each other until the spring assembly is fully compressed, as is the case when goods are being conveyed vertically.

The movement between the parts of the wheel shall be adjusted so as to ensure that the inclination of plane the axes of the shafts including in relation to the longitudinal extension of the guide-rail is adequate. Too small an angle will result in an excessively high normal pressure and excessive wear. Too large an angle will result in excessively low normal pressure and inadequate holding force. The latter range of angles is dependent on the coefficient of friction. Reference may be made to the fact that steel against steel produces a coefficient of friction of 0.1 and that the angle B measured between the plane including the shaft axes and a normal or ninety degree transverse plane to the guide rail. (FIG. 5) should not exceed 15°.

A holder 94 is arranged around the wheel 8, and a similar holder 95 is arranged around the wheel 9. Any fracture of one or both of the shafts 10,12 will result in the device being held tightly against the guide-rail 2.

The variable spring tension is best achieved by specifiying that one of the Belleville spring washers 93 shall be softer than the other two. Thus, when part 91 moves away from part 92 of the wheel 9 there is initially a light spring pressure as the softer spring washer is compressed. Further movement results in increased spring pressure as the stiffer washers are compressed.

FIG. 6 also shows that the point of contact "A" of the load is located at a certain distance "d" away from the centre-line of the guide-rail 2 and on the opposite side to the driving motor 14 and the gear box 13 for reasons of balance.

The present invention is not, of course, restricted to the embodiment described above by way of an example, but may be modified within the context of the following Patent Claim.

I claim:

1. A conveying apparatus comprising a guide rail having a horizontal portion and an inclined portion and a conveyor mechanism movable along said guide rail and adapted to support a load;

said guide rail having a cross-sectional configuration of a polygon throughout its length and first and second opposed wheel contacting surfaces, each wheel contacting surface including two sides forming an angle therebetween;

said conveyor mechanism including two wheels rotatable, respectively, about first and second axes of rotation, means for driving said wheels in synchronism and means for supporting a load spaced a predetermined distance from said wheels, and wherein the plane including the axes of rotation of the wheels forms for different degrees of inclination, a variable angle with a plane of a normal transverse cross-section of the guide rail and said angle does not exceed 15° when the conveyor mechanism is on said inclined portion;

said wheels mounted on opposite surfaces of said guide rail and each having a periphery shaped to complimentary engage the two angled sides of each wheel contacting surface;

wherein one of the wheels being split at right-angles to its axis of rotation so that two wheel parts are provided and a spring bearing means is provided for urging one of the wheel parts towards the other part; and wherein said means for driving said wheels includes a driving motor, a gear box connected to said motor and a plate, wherein the motor and gear box are located on one side of the plate and the wheels and means for supporting the load are located on the other side of the plate.

2. A conveying apparatus as set forth in claim 1 wherein when a portion of the guide rail is horizontal the two wheels and means for supporting a load are located substantially in a vertical plane.

3. A conveying apparatus as set forth in claim 1 wherein the distance between the axes of rotation of said wheels is substantially equal to the distance between one of said axes of rotation and said means for supporting a load.

4. A conveying apparatus as set forth in claim 1 wherein said means for supporting a load includes a sleeve rotatably mounted on a fixed shaft.

5. A conveying apparatus as set forth in claim 2 wherein said means for supporting a load includes a sleeve rotatably mounted on a fixed shaft and said fixed shaft is attached to the plate.

6. A conveying apparatus as set forth in claim 1 wherein the spring biasing means provides a variable spring pressure which increases as said one of the parts moves away form said other part.

7. A conveying apparatus as set forth in claim 1 wherein a holder means for enclosing each of the driving wheels is provided.

8. A conveying apparatus as set forth in claim 6 wherein a holder means for enclosing each of the driving wheels is provided.

* * * * *